United States Patent [19]

Lloyd et al.

[11] 4,315,270

[45] Feb. 9, 1982

[54] BACKUP ELECTRODE FOR AN ELECTROSTATIC RECORDER

[75] Inventors: William A. Lloyd, Saratoga; David D. Thornburg, Los Altos, both of Calif.

[73] Assignee: Xerox Corporation, Stamford, Conn.

[21] Appl. No.: 101,028

[22] Filed: Dec. 6, 1979

Related U.S. Application Data

[63] Continuation of Ser. No. 911,584, Jun. 1, 1978, abandoned.

[51] Int. Cl.[3] ..... G03G 15/04

[52] U.S. Cl. ..... 346/155; 346/153.1

[58] Field of Search ..... 364/155, 153, 139 C, 364/154, 163, 165

[56] References Cited

U.S. PATENT DOCUMENTS

| | | | |
|---|---|---|---|
| 2,930,847 | 3/1960 | Metzger | 346/154 X |
| 2,955,894 | 10/1960 | Epstein | 346/154 |
| 3,124,804 | 3/1964 | Johnson | 346/155 |
| 3,196,451 | 7/1965 | Jones et al. | 346/154 |
| 3,693,181 | 9/1972 | Marshall et al. | 346/153 |
| 3,718,936 | 2/1973 | Rice, Jr. | 346/155 |
| 3,827,056 | 7/1974 | Vano | 346/139 C |
| 3,946,400 | 3/1976 | Burd | 346/155 |
| 3,953,861 | 4/1976 | Kipling | 346/139 C |
| 4,013,158 | 3/1977 | Strange | 346/139 C |
| 4,030,107 | 6/1977 | Tagawa | 346/155 |
| 4,183,032 | 1/1980 | Ohbori et al. | 340/154 |

FOREIGN PATENT DOCUMENTS

| | | | |
|---|---|---|---|
| 2235423 | 1/1973 | Fed. Rep. of Germany | 346/154 |

*Primary Examiner*—John H. Wolff

*Attorney, Agent, or Firm*—W. Douglas Carothers, Jr

[57] ABSTRACT

A backup electrode arrangement comprises a resilient insulating member across one surface of which are a plurality of electrode segments separated from one another and comprising an electrically resistive material forming a shoe. The electrode shoes provide pressure engagement against an array of recording electrodes in an electrostatic recorder with a recording medium disposed therebetween. The electrical resistivity of the shoes is sufficiently high to protect the recording electrodes from pinhole shorts in the dielectric layer of the recording medium. With the backup electrode positioned directly opposite to the recording electrode array, the charging path impedance is reduced permitting reduction in writing speed and a corresponding increase in overall recording time.

9 Claims, 6 Drawing Figures

BACKUP ELECTRODE FOR AN ELECTROSTATIC RECORDER

This is a continuation of application Ser. No. 911,584, filed June 1, 1978, now abandoned.

FIELD OF THE INVENTION

This invention relates to electrostatic recorders employing a charging path between recording electrodes and backup electrodes though which a recording medium travels and more particularly to an improved backup electrode arrangement for employment in such recorders.

BACKGROUND OF THE INVENTION

The most widely used stylus type electrostatic recorders today apply a charge to a recording medium through a pair of coincident voltage pulses applied to opposite sides of the recording medium by means of a plurality of stylus electrodes and backup or counter electrodes. The backup electrode arrangement usually takes the form of a plurality of U-shaped shoes fabricated from a metal block having an elongated channel. The U-shaped backup electrode arrangement, as compared, for example, to the empolyment of a flat plate backup electrode arrangement, provides reduced wear on the stylus electrodes and its head assembly while also protecting to some extent the stylus electrodes from dielectric breakdown.

Head wear in this older arrangement was reduced because the spaced but parallel lips of the U-shaped backup electrode provided minimal contact with the recording medium, permitting the medium to freely adjust to accomodate for small physical fluctuations in the profile of the stylus head. Complete dielectric breakdown was minimized because the effective resistance of the recording medium in contact between the backup electrode lips and the stylus electrodes provided sufficient protection against pinhole shorts in the recording medium which would otherwise cause machine damage to the stylus electrodes and recorder circuitry.

However, the U-shaped backup electrode arrangement having been successfully employed in the past has not been so employed without several disadvantages. To begin with, their fabrication entails detail fabrication and expensive production costs. The alignment of the backup electrode segments relative to the stylus head during installation in the recorder is time consuming.

The U-shaped backup electrode arrangement provides an recording medium increment in the charging path between the recorder electrodes, the impedance value of which is variable. To begin with, the printout quality of these electrostatic recorders depends strongly on the conductivity nature of the paper base or substrate of the recording medium, which varies along the length of the medium, as well as, from roll to roll of the recording medium. The variances of conductivity is usually the result of the paper characteristic itself and may be contributed to by changes in relative humidity. The changes in conductivity affects the charging characteristics in the charging path between the backup electrodes and the stylus electrode array, subjecting solid black areas during development, to striations in the direction of recording medium travel. These are undesirable, as they cause a blurred appearance of the overall developed image.

Lastly, because there is an effective recording medium increment included in the charging path between the stylus electrode array and the lips of the U-shaped backup electrodes, parallel charging paths are created which increase the charging path impedance thereby necessitating longer write times. Longer write times (longer charge depositing time due principally to a higher RC time constant in the charging path) means a slower printing process.

One manner of improving printer speed is to decrease this impedance in the charging path while not subjecting the recorder to an increased likelihood of pinhole shorting through the recording medium while further providing efficient recording medium alignment for faster movement of the recording medium through the recording station and the development station.

U.S. Pat. No. 3,693,181 suggests the reduction of the impedance in the charging path, as well as, casing the alignment problem by providing a backup electrode arrangement having a concaved conductive surface overlying a resilient spongy layer. However, this conductive type backup electrode presents the danger of recorder damage, particularly to the stylus electrodes, due to pinhole shorts through the recording medium. A pinhole short across the charging path will blow out or burn up the electrode nibs of one or more recording stylus in the head assembly rendering the recording head useless for future use. Also, printout quality will still be affected by conductivity changes of the moving recording medium.

OBJECTS OF THE INVENTION

A principal object of this invention is an improved backup electrode reducing or otherwise eliminating the aforementioned disadvantages.

Still another object of this invention is the provision of a plurality of backup electrodes each having an electrically resistive pad or shoe in the charging path effectively eliminating any pinhole shorting problem.

The backup electrodes of this invention, because of the nature of their resistivity, eliminate the need of employing a resistor in the lead circuits connected to the stylus electrodes.

A still further object of this invention is a backup electrode arrangement which provides improved print quality on high resistivity recording mediums. The backup electrode of the present invention permits use of pure dielectrics, such as, Mylar, as a recording medium eliminating the need of a combination type of a medium that is commonly used and comprises a dielectric layer on a fairly conductive substrate, such as, paper.

SUMMARY OF INVENTION

In accordance with the invention, a backup electrode assembly is provided at the recording station in the form of a plurality of electrode segments on a resislient insulating member which may be a printed circuit board (PCB). Each segment is separated from one another and comprises a conductive strip on the PCB to which is electrically secured a shoe or pad of electrically resistance material. The shoe may have an underlayer of foam or otherwise resislient type material to provide local dynamic pressure adjustment of the backup electrode assembly relative to the oppositely opposed array of recording stylus electrodes. The electrical resistivity of the shoes is sufficiently high to protect the recording electrodes from pinhole shorts through the dielectric layer of the recording medium while permitting reduction of the charging path impedance reducing the RC time constant for charge acceptance of the recording medium.

Other objects and attainments together with a fuller understanding of the invention will become apparent and appreciated by referring to the following description and claims taken in conjunction with the accompanying drawings.

Figure 1:
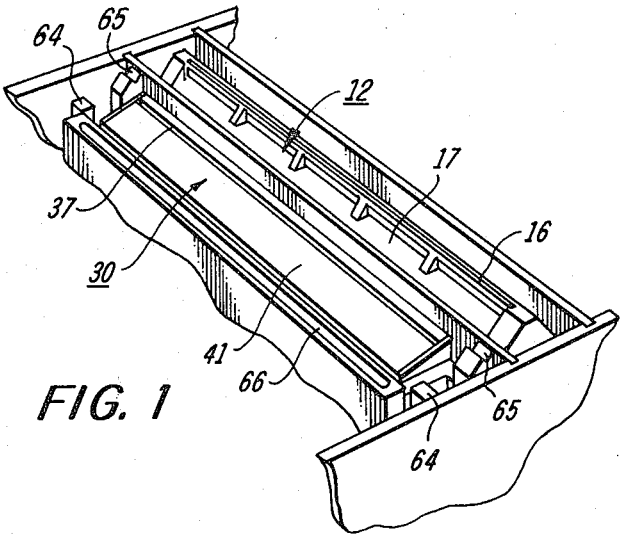
FIG. 1 is a perspective view showing the relative positional relationship of recording station and development station in a electrostatic recorder.
Figure 2:
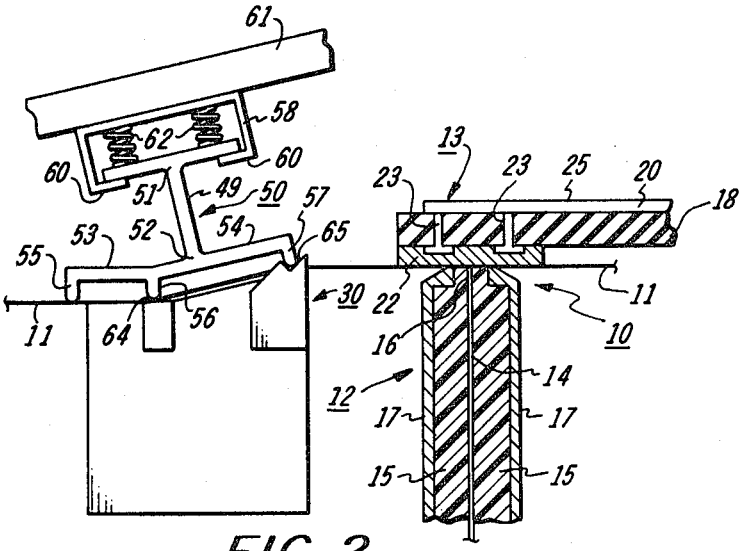
FIG. 2 is an end view, with parts in cross section, of the recording and development stations of an electrostatic recorder.
Figure 3:
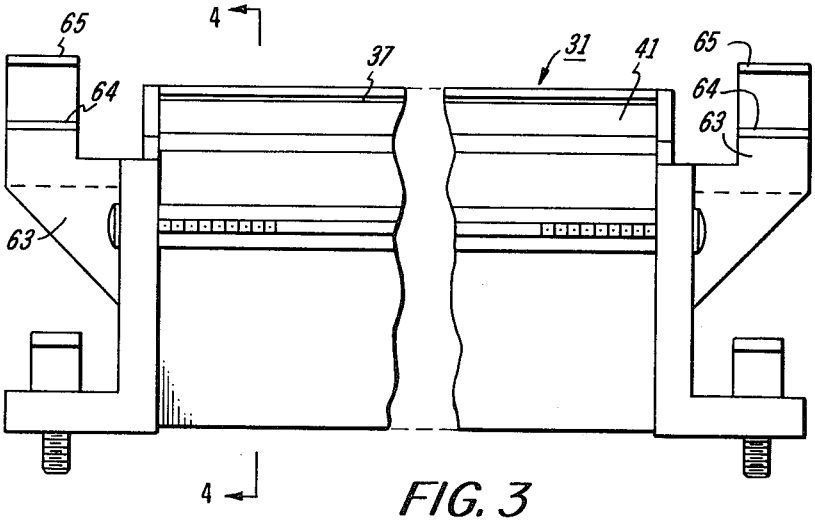
FIG. 3 is a front elevation of the developer fountain assembly at the development station with parts shown broken away.

Referring now in particular to FIGS. 1, 2 and 3, there is featured the recording station 10 and development station 30 which may be employed in electrostatic recorders of the types disclosed in U.S. Pat. Nos. 3,729,123 and 4,042,939 and assigned to the assignee of the present application, the disclosures of these patents being incorporated herein by reference.

Figure 6:
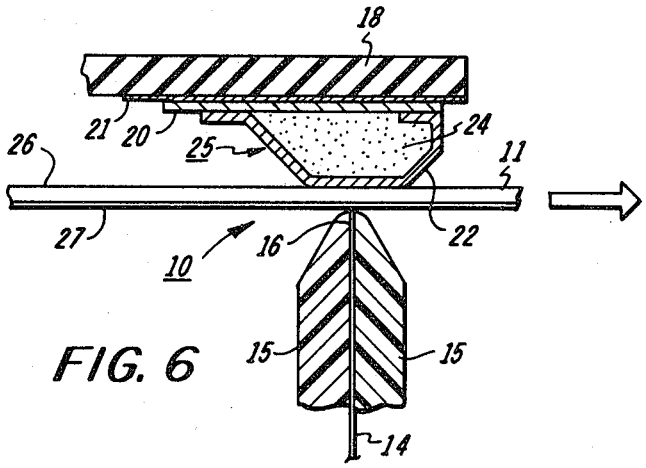
FIG. 6 is a cross-sectional view of another embodiment of a backup electrode assembly comprising this invention.

A web of electrostatic recording medium 11 may be a dielectric material or a combination paper substrate 26 and dielectric layer 27 as shown in FIG. 6.

The recording station 10 comprises an electrostatic recording head assembly 12 and a backup electrode assembly 13 positioned in oppositely opposed relationship. The recording head assembly 12 consists of a plurality of stylus type electrodes 14 embedded in an epoxy or other plastic material 15 to form an array of evenly spaced electrodes having nibs 16 which may protrude a very small amount from the upper end of the recording head 12. However, nibs 16 do not protrude so far as to actually contact medium 11.

The recording head 12 is supported within an outer metallic jacket 17 which provides a convenient means for securing the recording head assembly 12 to the frame of the electrostatic recorder of the type disclosed in the above identified patents.

The backup electrode assembly 13 at the recording station 10 comprises a flexible or resilient support member which may be a printed circuit board (PCB) 18. Each of the backup electrodes comprises a conductive strip 20 to which is secured a resistive strip, pad or shoe 22. Each resistive shoe 22, as well as accompanying conductive strip 20 are electrically isolated from adjacent backup electrodes as best illustrated in FIG. 5.

Figure 5:
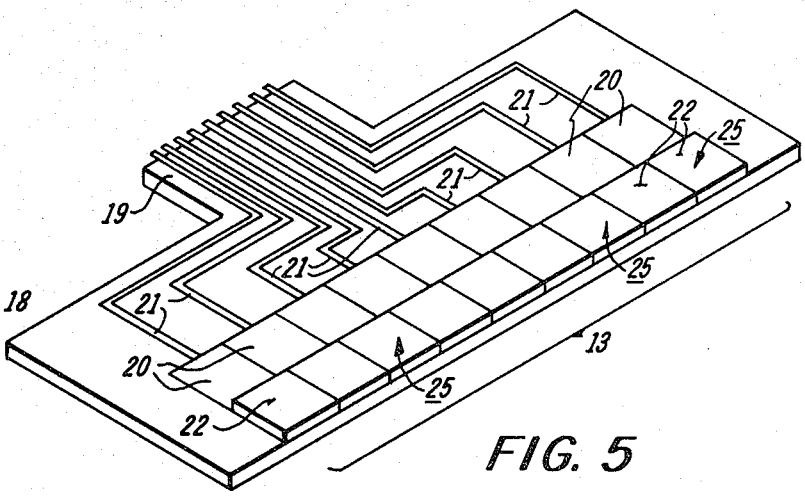
FIG. 5 is a perspective view of a backup electrode assembly comprising this invention.

The arrangement of backup electrode segments 25 in FIG. 5 is substantially the same as the cross sectional configuration shown in FIG. 2, except that in FIG. 2 the conductive strip 20 is formed on the opposite side of the printed circuit board (PCB) 18 from the resistive shoe 22. On the other hand, in FIG. 5 the resistive shoe 22 is formed directly on the conductive strip 20 on the same side of the printed circuit board (PCB) 18. The conductive strips 20 of each backup electrode is connected by a conductive wire lead or printed circuit lead 21 to suitable coupler 19 to recorder control means which provides printing input pulses to selected electrode nibs 16 opposite selected ones of the backup electrodes segments 25 will be permitted to provide a charge deposition on the moving recording medium 11.

In the arrangement shown in FIG. 5, the resistive shoes 22 may be secured to the conductive strips 20 by means of a conductive filled epoxy adhesive, such as, silver filled epoxy. In the embodiment shown in FIG. 2, the resistive shoes 22 may be electrically connected to the conductive strips 20 as well as properly secured to the PCB 18 by means of the conductive strips 20 as well as properly secured to the PCB 18 by means of the conductive fastening members 23. As previously indicated, the resistive shoes 22 may take the form of a pad or shoe as illustrated in FIGS. 2 and 5 or merely be a strip of resistive elastomeric sheet material, as long as the resistive material provides a sufficient level of resistivity in ohms per square. When using resistive elastomeric sheet material, it has been found that a sheet of 5 mils thickness having a sheet resistivity of sixty (60) thousand ohms per square was suitable for the arrangement shown in FIG. 5. Such sheet material may be obtained from Wescorp and comprises carbon loaded polyolefin film. The resistive shoe structure as shown in FIG. 2 would also have resistance value in the range of sixty (60) thousand ohms per square. The principal point is that the resistance value per unit area should be sufficient to prevent damage to the recording stylus electrodes due to an electrical short condition in the charging path but not of such a high value to provide an impedance in the charging paths that significantly increases the writing times of the recording styli. The shoe material must also have high wear resistance since the backup electrodes are in continuous contact with the moving recording medium.

The PCB 18 may comprise an epoxy glass laminate. The printed circuit board (PCB) 18 with its resistive shoes 22 is mounted in the electrostatic recorder so that the resistive shoes 22 are positioned directly opposite of the stylus array of the electrostatic recording head 12. The printed circuit board (PCB) 18 is resilient and may be spring loaded in a cantilever fashion to provide a force against the recording medium 11 and the electrostatic recording head 12. Accurate adjustment of the alignment of the backup electrode assembly 13 relative to the stylus electrode array 14 of the recording head 12 is not necessary. Thus, the resiliency of the printed circuit board (PCB) 18 construction of the backup electrodes eliminates the need of any critical alignment between the recording head 12 and the backup electrode assembly 13.

The conductive strips 20 may be fabricated on the printed circuit board (PCB) 18 by means of etching the conductive electrode pattern in a copper cladded laminate using conventional photolithographic processing. The copper clad board may have a thickness of 0.020 inch. The overall dimensional structure of the electrode segment 25 may be 0.620 inch wide with 0.030 inch gaps between electrode segments. Of course, the length of the electrode segments, and, in particular, the conductive strips 20, may be of variable lengths depending upon the width of the PCB 18.

Reference is now made to FIG. 6 where there is shown a modified form of the backup electrode 25 of FIGS. 2 and 5. In FIG. 6 the PCB 18 is provided again with a conductive strip 20 secured to one surface of the board and connected to a terminal point by means of the conductive leads 21. The resistive shoe 22 in the form of a strip element is provided with a foam underlayer 24 and secured to the conductive strip 20 by means of a conductive filled epoxy adhesive.

In this embodiment, the automatic pressure adjustment of the backup electrode assembly is more pronounced, in that, there may provide not only the spring loading of the printed circuit board (PCB) 18, previously mentioned, but also the local deformability of the foam underlayer 24 as applied to the stylus array 14 to provide for the automatic dynamic pressure adjustment and contact uniformity along the length of both electrode assemblies.

By providing a sufficient resistivity level in the shoes 22, the length of the charging path as compared to backup electrodes of the U-shaped configuration is materially changed thereby reducing the effective impedance and RC time constant so that a decrease in stylus write times is possible. For example, the impedance in the charging path of electrode arrangement employing the U-shaped backup electrode configuration may be 20 megaohms and require a writing time of 250 microseconds. However, the employment of the backup electrode arrangements disclosed herein may reduce the write time to 1 microsecond.

At the same time electrical shorts possible in the dielectric layer of medium 11 and their damaging effect on the electrode nibs 14 is eliminated by providing a sufficient resistance level in the shoes 22. Also, the conductivity requirements of the conductive paper base of recording mediums now presently used with such electrostatic recorders can be somewhat relaxed in view of the fact that the resistive shoes 22 are now placed in direct opposite relationship to the stylus electrode array 14 providing a direct charging path across the medium 11. With the resistive shoes 22 being of sufficiently high resistance, the electrode nibs as well as the driving electronics for the stylus type electrodes 14 will be protected against inadvertent pinhole shorts in the dielectric material in the recording medium 11.

With the employment of a backup electrode assembly 13 comprising this invention, it is possible to use highly resistive recording mediums. In fact, electrostatic images may be produced on pure dielectric mediums, such as, 0.5 mil Mylar.

Figure 4:
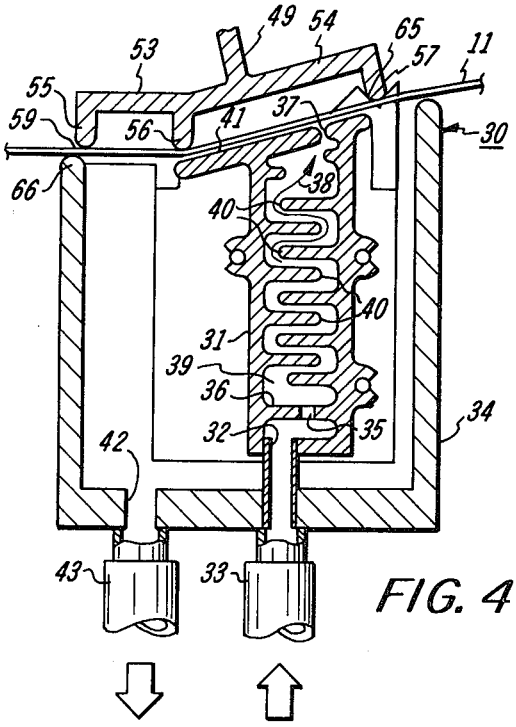
FIG. 4 is a cross-sectional view taken along the line 4—4 of FIG. 3.

The development station 30 shown in FIG. 4 comprises a fountain assembly 31 having an inlet 32 in communication with conduit 33 for receiving liquid toner material from a supply resevoir (not shown). This station 30 also includes a catch basin receptacle 34 which encircles the fountain assembly 31. Due to the smallness of aperture 35 in fountain 31 which aperture may be provided at one or more points along the structural member 36, the liquid toner is evenly distributed along the width of the bottom chamber 39 of the fountain assembly 31 for uniform distribution and subsequent uniform laminar flow out of outlet 37 of assembly 31. The liquid toner preceding from aperture 35 is caused to follow a serpentine path 38 provided by the elongated and altering internal extension members 40. The serpentine path 38 causes the liquid toner at outlet 37 to provide a uniform laminar flow along the length of incline surface 41 of the fountain assembly 31. At the bottom of incline surface 41, the liquid toner material falls into the catch basin receptacle 34 where it drains away via aperture 42 and outlet conduit 43 for turning to the toner supply reservoir.

Also shown in FIGS. 2 and 4 is recording alignment guide 50 which, in general, comprises the moveably mounted support member 49 and the housing 58. The support member 49 includes T-shaped section 51 integral with a base section 52.

Base section 52 is provided with two subsections 53 and 54 which are at a different angular relationship relative to each other. This angular relationship fits the contour of the fountain surface 41 and forms the aperture 59, mentioned in more detail hereafter. Base section 52 is further provided with three downwardly depending guide lip members, 55, 56, and 57, which are designed to cooperate with recording mediums 11 in guiding the same through the development station 30, as well as provide for proper alignment and spacing of the medium relative to the fountain assembly 31 by means of a special seating arrangement provided with the fountain assembly 31.

As shown in FIG. 2, the T-section 51 of support member 49 is supported within a U-shaped housing 58 having inwardly opposed lips 60. Housing 58 is secured by suitable means, for example, to the top cover 61 of a electrostatic recorder.

As illustrated in U.S. Pat. No. 4,042,939, such a top cover in a recorder of this type is pivotably mounted at the rear of the recorder. Closure of the cover 61 will cause the moveable mounted support member 49 to properly seat, align and maintain a fixed relationship relative to the fountain assembly 31.

The support member 49 is spring loaded in housing 58 by means of spring members 62. Thus, when top cover 61 is pivoted in an upward position away from the development station 30, the spring members 62 will cause the T-section 51 of member 49 to seat against the inwardly directed lips 60.

Arm members 63 are provided at adjacent ends of the fountain assembly 31. Seating pads 64 and 65 are provided on arm members 63 for receiving in mating relationship the outer extremeties of guide lip members 56 and 57, respectively. Seating pads 64 may be substantially flat in contour while seating pads 65 are each in the form of a V-shaped notch. The notched pads initially receive the extremities of the member 57 upon lowering of the top cover 61 to initially seat the support member 49 relative to assembly 31. Upon further downward movement of top cover 61, support member 49 may slightly rotate within V-shaped notches 65 against the biasing pressure of spring members 62 and properly seat the outer extremities of lip member 56 on seating pads 64.

Downwardly extending lip member 55 serves to cooperate with the upward extending lip 66 to provide an aperture 59 through which the recording medium 11 egresses from the development station 30 when the top cover 61 is in its closed position. The lip 66 acts as a rigid wiper blade for removing excess liquid toner from the developed image on the under surface of the recording medium. A vacuum may be applied as part of the development station 30 to hold the recording medium against lip 66 as shown and described in U.S. patent application Ser. No. 553,591 filed Feb. 27, 1975, now U.S. Pat. No. 4,173,945.

From the above, it can be seen that the lip members 55, 56 and 57 serve to confine and control the travel of the web of recording medium 11 as it passes through the development 30 in close proximity to the top surface 41 of the fountain assembly 31. Also the recording medium 11 will ride lightly across the wiping lip 66 for removal of excess toner material.

Support member 49 may be grounded so as to remove any charge remaining on the back of the recording medium 11.

In summary, automatic adjustment by support member 49, upon closure of cover 61, is accomplished for proper alignment and maintenance of the recording medium 11 relative to the liquid toner being expelled from outlet 37 of fountain assembly 31. Upon such cover closure, support member base section 52 is initially seated by means of the V-shaped notch seating pads 65 and then sequentially placed in proper alignment position by its slight pivotal movement within seating pads 65 until the outer ends of lip member 56 have made contact with the surface of seating pads 64. It is not necessary that exact or precise adjustments be made or tolerances provided relative to the fixed position of housing 58 secured to top cover 61 and the fountain assembly 31. Due to the biased mobility of support member 49 within housing 58, lip member 57, upon cover closure, will be properly guided and located within the V-shaped notch seating pads 63. Pads 63 initial positioning and alignment of support member 49 so that proper alignment and lip spacing of the lip member 55, 56 and 57 relative to the surface of fountain assembly 31 and upwardly extending lip 66 is automatically provided.

While the invention has been described in conjunction with specific embodiments, it is evident that many alternatives, modifications and variations will be apparent to those skilled in the art in light of the foregoing description. Accordingly, it is intended to embrace all such alternatives, modifications and variations as fall within the spirit and scope of the appended claims.

What is claimed is:

1. An electrostatic recorder for forming an electrostatic image on a recording medium interposed between an array of backup electrodes positioned in opposite and opposed relation to an array of recording electrodes, a charging path established between pairs of said electrodes upon appropriate electrical addressing thereof, said backup electrodes characterized by each comprising an electrically resistive thin elastomeric strip element mounted on a resilient foam like support, said element being electrically isolated from adjacent elements and electrically independent of its support, said element having a resistance value sufficient to prevent damage to the recording electrodes due to an electrical short condition in said charging path.

2. The electrostatic recorder of claim 1 wherein said foam like supports are selected to have sufficient local deformability to provide for uniform medium contact along the length of said electrode arrays and automatic dynamic pressure adjustment between said electrode arrays.

3. The electrostatic recorder of claim 1 or 2 wherein said element mounted foam like supports are secured in a linear array on the surface of a resilient insulating base member, a plurality of conductor means on said member, each electrically connected to a respective resistive strip element.

4. In an electrostatic recorder for forming an electrostatic image on a recording medium interposed between at least one backup electrode positioned in opposite and opposed relationship with at least one recording stylus electrode, and wherein a charging path is established between said electrodes upon appropriate electrical addressing thereof, said backup electrode including an electrically resistive shoe on a support member, said shoe arranged to engage said recording medium, conductive means provided on said member and coupled to said shoe for said electrical addressing thereof, said shoe having an electrical resistance value sufficient to prevent damage to the recording stylus electrode due to an electrical short condition in said charging path between said electrodes.

5. In the electrostatic recording according to claim 4, an array of backup electrodes and an array of recording stylus electrodes positioned in opposite opposed relationship, said backup electrodes including a plurality of said electrically resistive shoes arranged in juxtaposed position to engage said recording medium, said shoes each being electrically isolated from one another and each electrically connected to independent conductive means provided on said support member, each of said shoes provided with said electrical resistance value.

6. In the electrostatic recorder according to claim 5, wherein said conductive means comprises a plurality of conductive strips on said insulating member, each of said resistive shoes being connected to a different one of said conductive strips.

7. In the electrostatic recorder according to claim 5, wherein an insulating foam like support is provided between said support members and said resistive shoes to provide local deformability of said resistive shoes.

8. An electrostatic recorder according to claim 5, wherein said conductive means comprises a plurality of conductive strips on one side of said insulating member, said resistive shoes being positioned along the opposite side of said insulating member, and electrical communicating means through said support member connecting each of said resistive shoes with a respective conductive strip.

9. In the electrostatic recorder according to claim 4 or 5, wherein a resilient insulating layer is provided between said support member and said resistive shoe(s) to provide local deformability of said resistive shoe(s).

* * * * *